US005688052A

United States Patent [19]

Compton

[11] Patent Number: 5,688,052

[45] Date of Patent: Nov. 18, 1997

[54] COMBINATION BEACH TOWEL AND TOTE BAG

[76] Inventor: Barbara Compton, 2991 Morgan Territory Rd., Clayton, Calif. 94517

[21] Appl. No.: 648,682

[22] Filed: May 16, 1996

[51] Int. Cl.[6] ..... B65D 30/22

[52] U.S. Cl. ..... 383/38; 383/4; 383/75

[58] Field of Search ..... 383/38, 39, 40, 383/4, 75, 66

[56] References Cited

U.S. PATENT DOCUMENTS

| | | | |
|---|---|---|---|
| 2,557,280 | 6/1951 | Hahn | 383/4 X |
| 3,477,552 | 11/1969 | Goldman . | |
| 4,011,898 | 3/1977 | Hubbard | 383/4 X |
| 4,188,988 | 2/1980 | Agyagos . | |
| 4,197,891 | 4/1980 | Comollo . | |
| 4,375,111 | 3/1983 | Hall . | |
| 4,404,687 | 9/1983 | Hager | 383/4 X |
| 4,468,810 | 8/1984 | Longo . | |
| 4,516,668 | 5/1985 | Grayek | 383/4 X |
| 4,856,912 | 8/1989 | Damus et al. . | |
| 5,110,219 | 5/1992 | Lopes . | |
| 5,346,308 | 9/1994 | Buhot et al. . | |
| 5,390,381 | 2/1995 | LaMantia . | |
| 5,454,643 | 10/1995 | Sullivan . | |
| 5,533,653 | 7/1996 | Kaufman | 383/4 X |

*Primary Examiner*—Jes F. Pascua
*Attorney, Agent, or Firm*—David H. Jaffer

[57] ABSTRACT

A beach towel and tote bag combination having a beach towel portion configured to accommodate a person. The bag portion is located at a corner of the beach towel and secured with a draw cord. Both secured and unsecured pockets are positioned on the inside of the tote bag when the beach towel is laid out. When the towel is rolled up and the bag turned inside-out, putting the towel inside the tote bag, the pockets are positioned on the outside of the bag.

6 Claims, 6 Drawing Sheets

COMBINATION BEACH TOWEL AND TOTE BAG

BACKGROUND OF THE INVENTION

1. Field of the Invention

This invention relates to a beach towel and tote bag combination and more particularly to an improved beach towel and tote bag combination that provides both secured and open pockets for transporting beach items.

2. Brief Description of the Prior Art

It is common for those going to the beach or pool to carry various items from one point to another, such as from the house to a car, and from the car to the beach or pool. Often it takes several trips to bring the umbrella, cooler, food, chair, beach towel, bathing attire, and beach bag with numerous items like sunscreen, sunglasses, book, radio, money, keys, driver's license and the like. Frequently, with hands full and towel over the shoulder, the beach bag adds to the awkwardness of the situation while inevitably dropping an item or two along the way. Attempts to alleviate this kind of problem have resulted in various combination beach towel and bag designs.

U.S. Pat. No. 5,110,219 by Lopes describes a combination beach mat/tote bag. The mat is bordered on two long sides with zippers which allow the sides to be joined to form a bag. U.S. Pat. No. 4,375,111 by Hall shows a two piece arrangement including a mat and zippered bag structure, wherein the mat as a separate structure can be folded and joined with the zippered bag. The designs of Lopes, Hall, and others have the disadvantage of requiring the use of a zipper, which can prove to be a discomfort to a person maneuvering on the mat/towel in a bathing suit. The zippers also are prone to misalignment and various other failure modes including jamming from sand. Another disadvantage of these designs is that they generally provide only a single bag enclosure into which must go all the various beach items that must then be dumped out in order to use the mat/towel.

A design of a somewhat different type is described in U.S. Pat. No. 4,856,912 by Damus et al. in which a combination beach towel and tote bag is disclosed that includes an annular seam with a pull cord centered on the towel. Pulling the cord converts the towel into a large bag. This invention also includes pockets located at the corners of the towel. U.S. Pat. No. 5,346,308 by Buhot et al. also describes a bag with a storage pocket that converts into a beach towel. This structure includes straps 4, bag (pocket) 3, and a flap 6 all centrally positioned on the towel 12. A disadvantage of the designs of Damus and Buhot is that the pockets, including seams and extra material, are located in the central towel/mat area upon which a bather's major body portion is likely to be positioned. Due to the central location of the pockets, all of the contents need to be emptied out in order to use the towel, and even then, the pocket seams and material would cause discomfort. In addition to the above disadvantages, no secure storage for items is provided while using the towel. Other disadvantages include the fact that pocket 3 of Buhot is relatively small, and the steps required to convert from beach towel to bag are relatively complicated.

U.S. Pat. No. 5,454,643 by Sullivan describes a rectangular beach towel with a single large pocket located in one corner. The towel can be folded, and then inserted into the pocket by turning the pocket inside out. A single draw cord is provided to close the opening. This design overcomes the problem of zippers and centrally located seams, but still has a disadvantage in that only a single pocket is provided in which all of the miscellaneous beach items must be deposited, and any items deposited in this pocket automatically fall out as the pocket is turned inside out in order to fold out the beach towel.

It is clear that there is a need for an improved beach towel and tote bag combination that is comfortable, economical to produce, and provides secure and convenient storage of the numerous miscellaneous items a person normally takes to the beach.

SUMMARY OF THE INVENTION

It is therefore an object of the present invention to provide a combination beach towel and tote bag that is free from seams and other irregularities in the center area of the beach towel.

It is a further object of the present invention to provide a combination beach towel and tote bag that is reliable and economical to manufacture.

It is another object of the present invention to provide a beach towel and tote bag combination providing secured and unsecured pockets that are on the inside of the bag when the towel is laid out.

It is a further object of the present invention to provide a beach towel and tote bag combination that can be quickly and easily converted from beach towel to tote bag and back again.

Briefly, a preferred embodiment of the present invention includes a beach towel and tote bag combination having a beach towel portion configured to accommodate a person. The bag portion is located at a corner of the beach towel and secured with a draw cord. Both secured and unsecured pockets are positioned on the inside of the tote bag when the beach towel is laid out. When the towel is rolled up and the bag turned inside-out, putting the towel inside the tote bag, the pockets are positioned on the outside of the bag.

An advantage of the present invention is the provision of a beach towel and tote bag combination that does not have any seams or other irregularities in the area where a person's main body parts normally lie.

A further advantage of the present invention is the provision of a beach towel and tote bag combination that has a large, secured bag for carrying items, in addition to smaller pockets for transferring items as well as retaining them when the towel is laid out for use.

A still further advantage of the present invention is the provision of a beach towel and tote bag combination that is reliable and economical to manufacture.

A further advantage of the present invention is the provision of a beach towel and tote bag combination that can be quickly and easily converted from a beach towel to a tote bag and back again.

IN THE DRAWINGS

DETAILED DESCRIPTION OF THE PREFERRED EMBODIMENT

Figure 1:
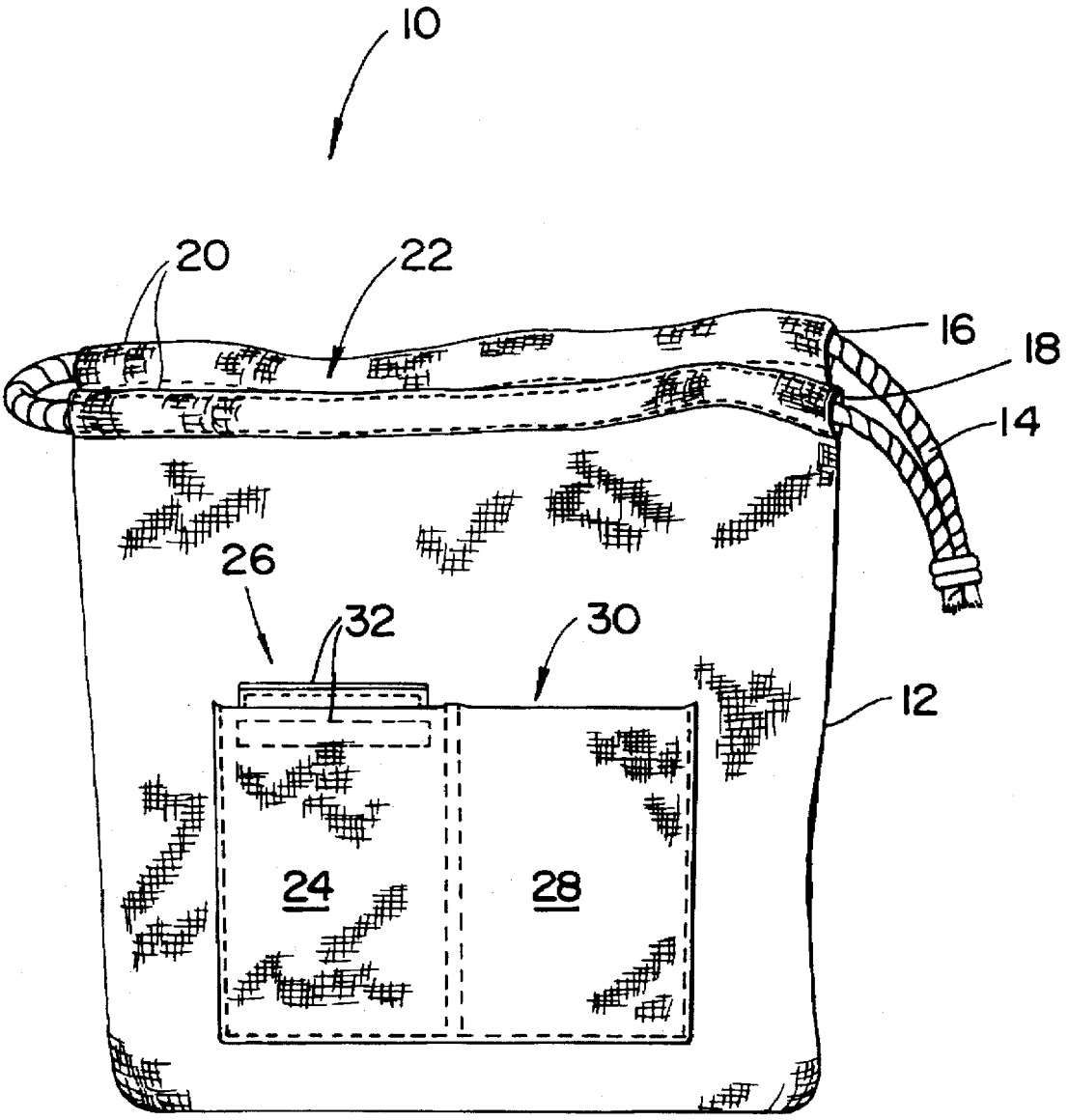
FIG. 1 shows the combination beach towel and tote bag with the towel folded and enclosed in the bag.

Referring now to FIG. 1 of the drawing, there is shown a preferred embodiment of the combination beach towel and tote bag 10 of the present invention with the beach towel (not shown) folded and inside the tote bag 12. A draw cord 14 passes through channels 16 and 18 extending around the perimeter 20 of the opening 22 of the bag 12. A secured pocket 24 with an opening 26 and an unsecured pocket 28 with an opening 30 are shown positioned on the outside of the bag 12. The secured pocket opening 26 is shown held closed by a tape material 32 such as Velcro™. Other methods of closing the opening 26 are also included in the spirit of the invention, such as buttons, snaps, draw strings, etc. known by those skilled in the art.

The position of the bag 12 on the towel, and the process of converting from beach towel to tote bag and back again will be fully described in the following text of the specification in reference to the figures of the drawing.

Figure 2:
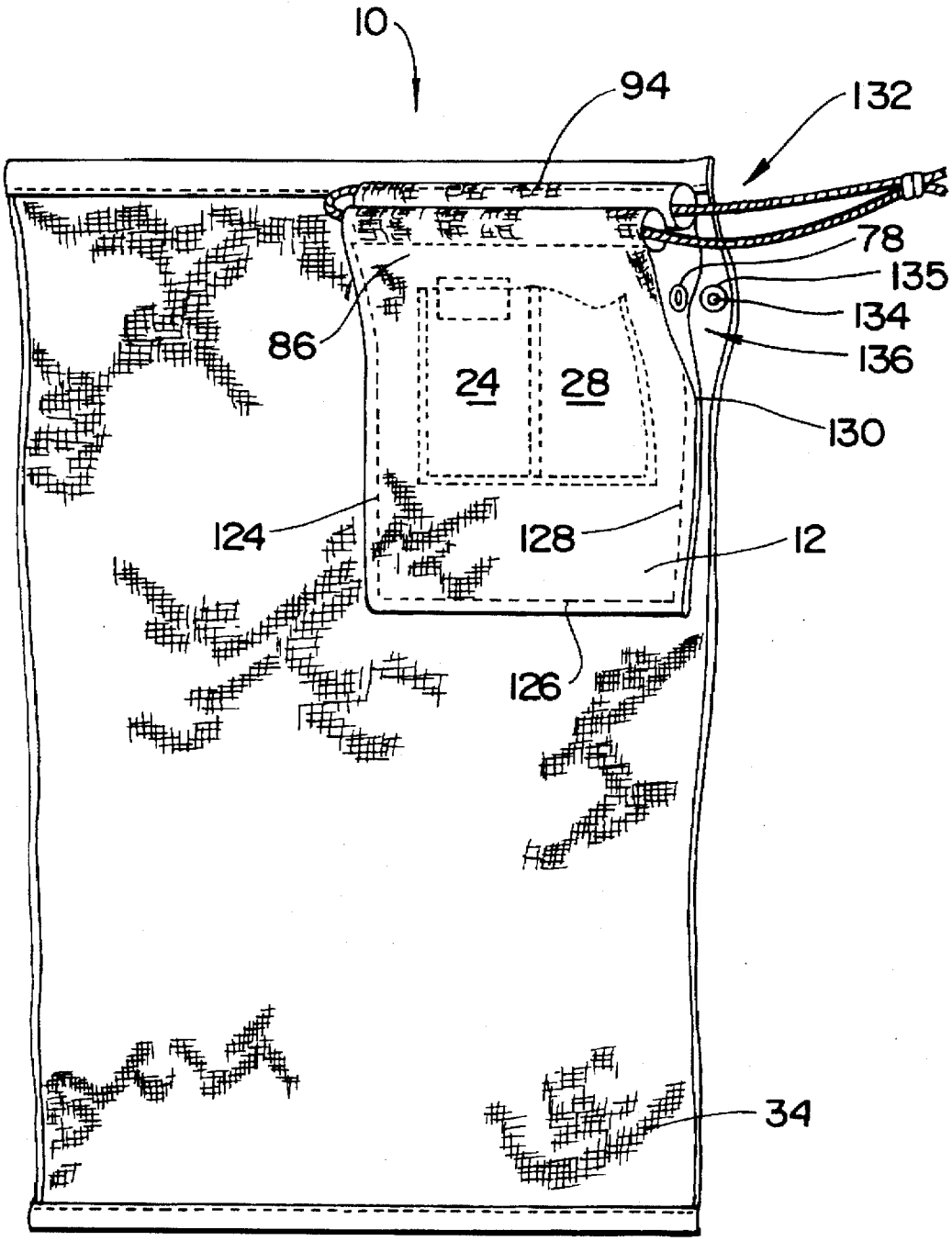
FIG. 2 shows the combination beach towel and tote bag with the towel laid out.

FIG. 2 of the drawing shows the beach towel and tote bag combination 10 with the towel 34 laid out. This is accomplished simply by turning the bag 12 as shown in FIG. 1 inside out, the process placing the towel 34 outside the bag 12. A novel feature of the present invention is evident from FIGS. 1 and 2, wherein the pockets 24 and 28 are on the outside of the bag as shown in FIG. 1 with the towel 34 inside, but when the bag 12 is turned inside-out with the towel 34 in position for use, the pockets are on the inside of the bag as shown in FIG. 2. Having the pockets on the outside in the configuration of FIG. 1 maximizes the use of the bag in a novel way, allowing maximum space for accessories inside the bag 12, with additional storage in the easily accessible pockets on the bag exterior. This configuration maximizes useable space and provides easy loading of the pockets 24 and 28. Being on the outside, the pockets 24 and 28 can also be loaded to a maximum without detracting from useable space inside the bag 12. Referring again to the configuration of FIG. 2, wherein the pockets 24 and 28 are on the inside of the bag 12, this arrangement provides added security for items in the pockets from falling out, and from being observed by others. The inside position of pockets 24 and 28 also helps to keep sand, etc. from getting in the pockets, which is an important feature in the storage of some items such as a camera that can be damaged by sand and salt.

It should be noted that although only one secured pocket 24 and one unsecured pocket 28 are shown, the spirit of the present invention also includes other numbers of secured and/or unsecured pockets.

Figure 3:
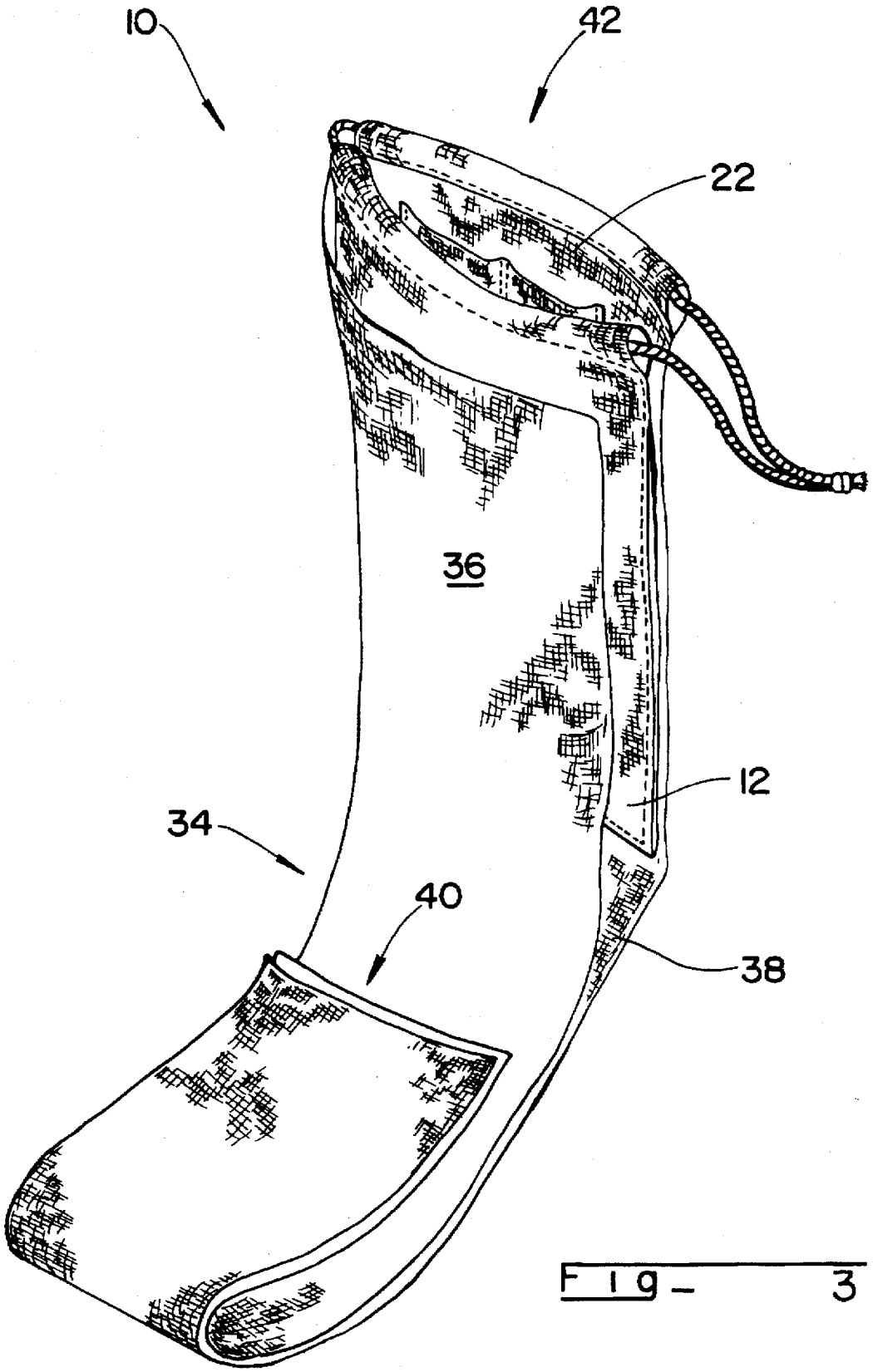
FIG. 3 illustrates the process of folding the beach towel.
Figure 4:
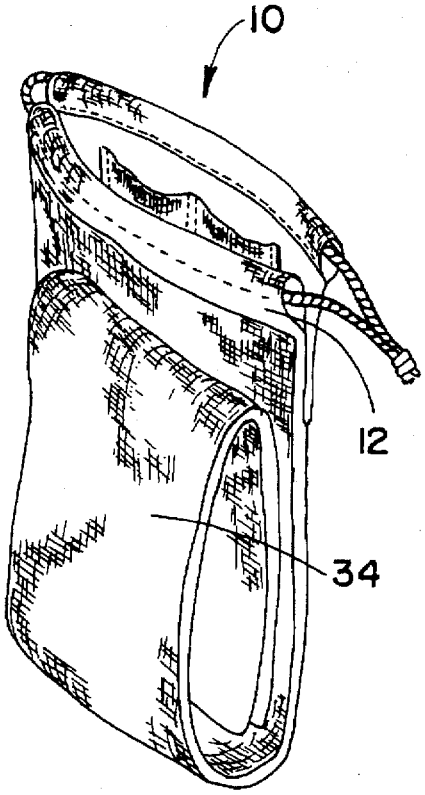
FIG. 4 shows the beach towel folded in place and ready to be inserted into the tote bag.
Figure 5:
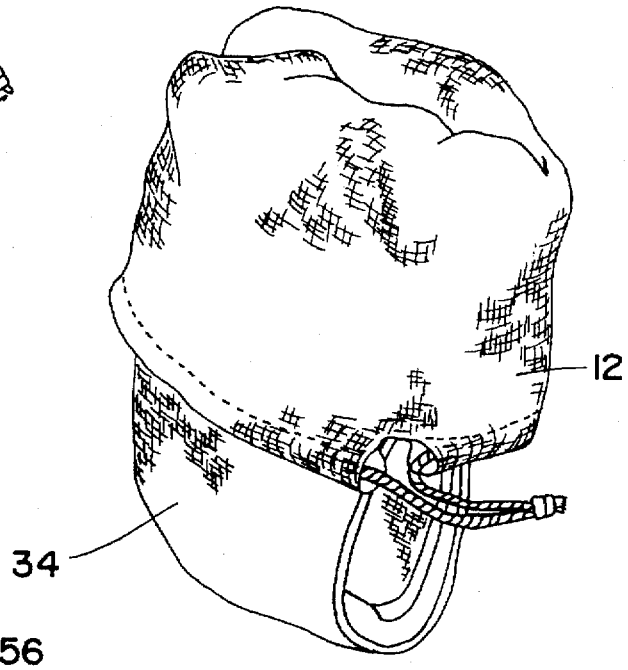
FIG. 5 shows the process of inserting the beach towel in the bag by turning the bag inside out.

The process of folding the towel 34 and inserting it into the bag 12 is illustrated in FIGS. 3–5. FIG. 3 illustrates folding a second side 36 of the towel 34 over a first side 38, upon which the bag 12 is secured, and then rolling or folding the towel from a second end 40 to overlay the bag 12 positioned with its opening 22 at a first end 42 of the combination 10. The result of the folding and rolling is shown in FIG. 4. The bag 12 is then turned inside-out as shown in FIG. 5, resulting in the rolled up towel 34 being deposited inside the bag 12, and the position of the pockets 24 and 28 moving from the inside as shown in FIGS. 2 and 3, to the outside as shown in FIG. 1.

A detailed description of a preferred construction of the preferred embodiment will now be described in the following text in reference to the various figures of the drawing.

Figure 6:
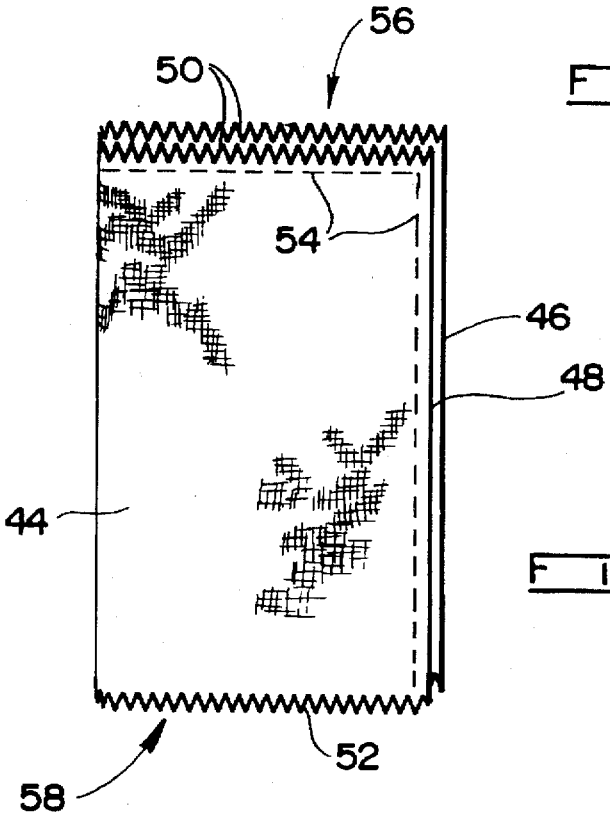
FIG. 6 illustrates the initial process of folding and stitching the bag material.
Figure 7:
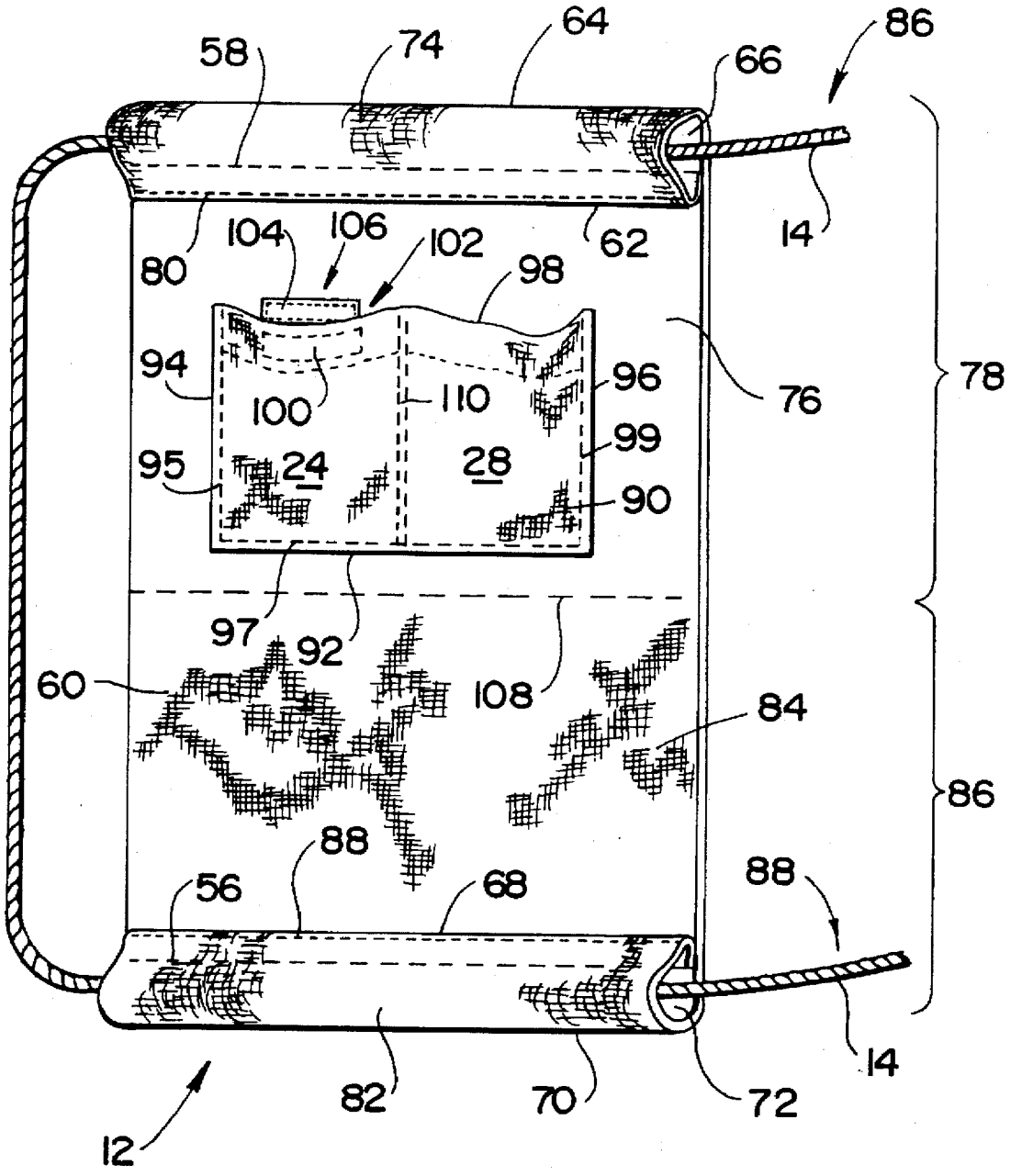
FIG. 7 illustrates the sewing of the pockets to the bag, and forming channels for a pull cord.
Figure 8:
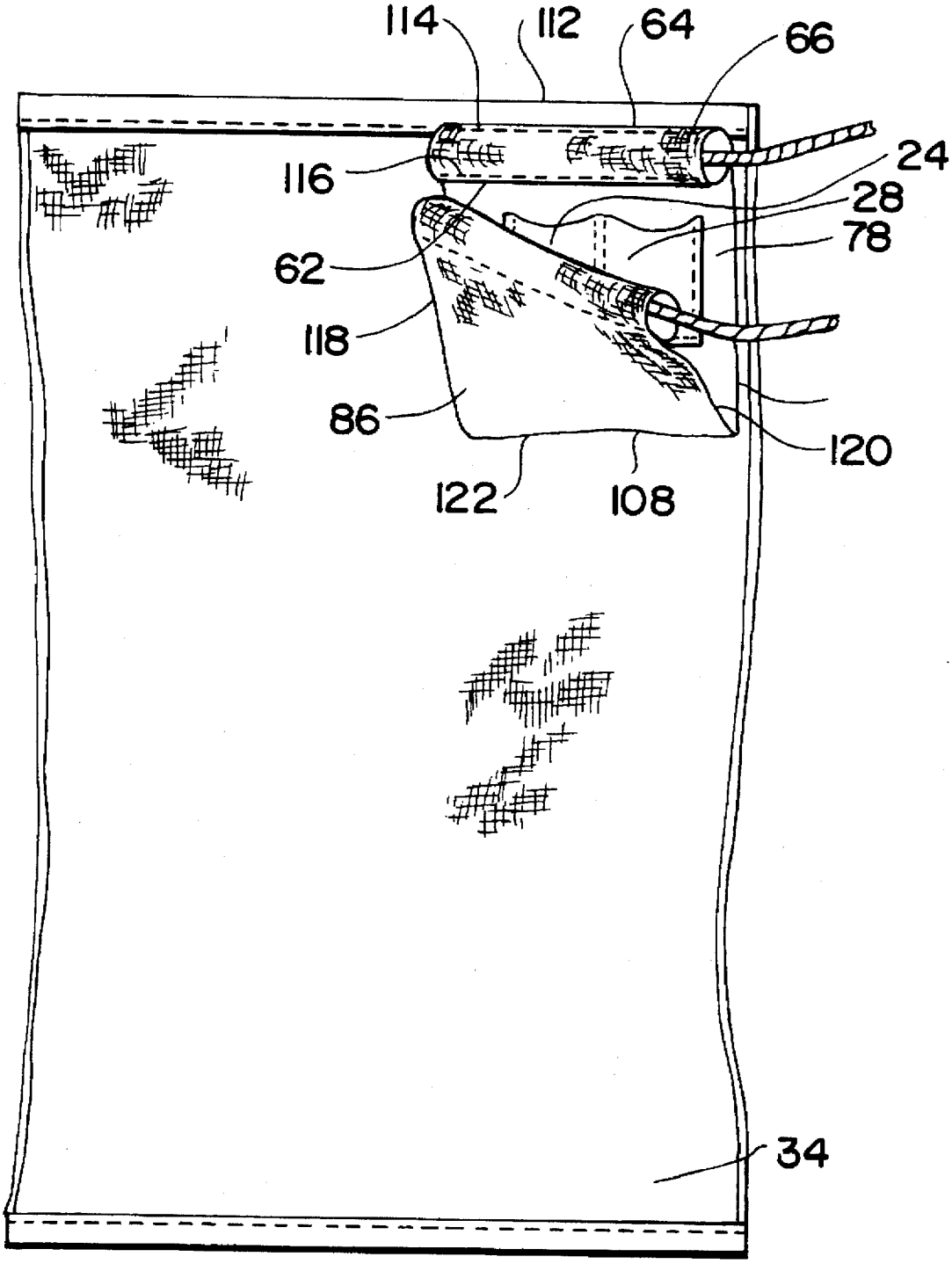
FIG. 8 illustrates the process of sewing the bag to the beach towel.

The bag 12 portion of the beach towel and bag combination is preferably constructed as shown in FIGS. 6 and 7 and attached to the towel 34 as shown in FIG. 8. FIG. 6 shows a rectangular fabric 44 having two 40" long first and second edges 46 and 48, and two 36" wide third and fourth opposing edges 50, 52. The 36" dimension is twice the 18" width of the fabric as displayed in FIG. 6, the fabric shown folded over itself with the first and second edges 46, 48 meeting each other and the third and fourth edges 50, 52 folded over on themselves. In the folded condition of FIG. 6, a stitch line 54 is made with a preferred ⅜" seam securing the two 18" lengths of the third edge 50 together to form a stitched short end 56 opposing an unstitched short end 58, and securing the first and second edges 46, 48 together. The resulting structure 60 of FIG. 6 is then turned inside out.

The next step is illustrated in FIG. 7, and involves folding the edges of the unstitched short end 58 of the structure 60 under ½" and pressing the fabric to form a crease line 62. From the crease line 62, the operation proceeds by measuring down 1 ½" and folding and pressing at line 64 to form a channel 66 for the draw cord 14. A similar process is performed on the stitched end 56, resulting in crease lines at 68 and 70, and a channel 72. The drawstring cord 14 is then laid in the channel 66 between folded portion 74 and a first side 76 of the structure 60. The first side 76 with channel 66 and pockets 24, 28 form what will be a first half 78 of the bag 12. A stitch line 80 near the crease line 62 is then made to secure the folded portion 74 to the side 76 to enclose the cord 14 in channel 66. The cord 14 is similarly laid in channel 72 between folded portion 82 and a second side 84, which will become a second half 86 of the bag 12. A stitch line 88 near the crease line 68 is then made to secure the folded portion 82 to the second side 84, enclosing the cord 14 in the channel 72. Preferably, four inches of cord is left extending out from each of channels 66 and 72 as illustrated at 86 and 88.

The pockets 24 and 28 are then prepared and sewn onto the structure 60 as follows. A piece of rectangular fabric 90 measuring 11"×12" is folded over ¼" at a bottom edge 92 and at first and second edges 94 and 96. The fabric 90 is further folded over 1" at the top edge 98, opposite the bottom edge 92. A piece of fabric tape 100 (such as Velcro™) is stitched to a first side 102 near the top edge 98, the first side 102 forming the inside of pocket 24. A piece of tape 104 is stitched to a corresponding location 106 on the structure 60. The fabric 90 is then stitched to the first side 76, the first side 76 distinguished from the second side 84 by fold line 108. Fabric 90 is stitched to the side 76 as shown by seams 95, 97 and 99 located near edges 94, 92 and 96 respectively. The first half 78 and second half 86 are also distinguished by the fold line 108. The fabric 90 is further stitched along a center line 110 parallel to and half way between the first and second edges 96 so as to form the two pockets 24 and 28. Pocket 24 as shown would be a secured pocket (with the tape 100, 104), and pocket 28 would be unsecured.

The partially completed bag structure of FIG. 7 is then sewn onto the beach towel 34 as described in reference to FIG. 8 to complete the assembly of the beach towel and bag. The second half 86 is folded over the first half 78 as shown in FIG. 8 with the pockets 24 and 28 covered by the second half 86. The first half 78 is placed in a corner of the beach towel 34, with the channel 66 in close proximity to the towel edge 112. The first half 78 is stitched to the towel 34 along lines 114 and 116 inside each of crease lines 64 and 62. The second half 86 is laid over the first half 78, and both halfs 78 and 86 are stitched to the towel at seams inside of first and second edges 118, 120 and bottom edge 122 at crease line 108 to form stitch lines 124–128 shown in FIG. 2. Referring now to FIG. 2, the stitch line 128 is shown terminated at a point 130 below the point 132 (FIG. 2) of the end of stitch line 116 (FIG. 8). This allows an opening (gap) 134 into a large (extra) pocket 136 (FIG. 2) formed between the first half 78 and the towel 34. The opening 134 is ideally dimensioned just large enough for a hand to enter, thereby providing some security for objects placed therein. A further alternate embodiment would include a closure for opening 134, such as a button or snap 135 or tape. Alternately, the stitch line 128 can be extended to the level 132 of stitch line 116 (FIG. 8), leaving no opening 134.

The preferred range of dimensions for the beach towel 34 are a length from 60 to 80 inches and a width from 24 to 40 inches for adults and a length from 48 to 60 inches and width from 24 to 30 inches for children.

The preferred dimensions of the fabric 44 (FIG. 6) of the bag for an adult sized beach towel and bag combination is 40" by 36" as noted above in reference to FIG. 6. For the children's sized beach towel and bag combination, the preferred size of fabric 44 is approximately 28" wide by 34" long.

Although a preferred embodiment of the present invention has been described above, it will be appreciated that certain modifications or alterations thereon will be apparent to those skilled in the art, such as different sizes, shapes and quantities of pockets, and different methods of construction. The above dimensions of the beach towel 34 are also given as a preferred embodiment, and other dimensions are also included in the spirit of the invention, as are other shapes of the towel and pockets. It is therefore requested that the appended claims be interpreted as covering all such alterations and modifications that fall within the true spirit and scope of the invention.

What is claimed is:

1. A beach towel and tote bag combination comprising:

a) a towel;

b) a bag having an opening and a means for closing said opening, said bag attached to said towel at a location away from a central area of said towel, said bag having a first half and a second half, wherein said first half of said bag is stitched along a perimeter of said first half to said towel forming an extra pocket between said first half and said towel, said extra pocket having an opening provided by a gap in said stitching along said perimeter;

c) means for closing said extra pocket; and d) one or more pockets attached to said bag, each having a pocket opening accessible from the inside of said bag with said towel laid out;

whereby when said towel is folded and stuffed inside said bag, facilitated by turning said bag inside out, said pockets are on the outside of said bag.

2. A combination as recited in claim 1 further comprising:

means for closing one or more of said pocket openings.

3. A combination as recited in claim 1 herein said towel is rectangular and having a width from 24 inches to 40 inches and a length from 60 inches to 80 inches.

4. A combination as recited in claim 3 wherein said bag is constructed from a 36 inch wide by 40 inch wide long rectangular piece of fabric and folded and stitched to form a rectangular shaped bag having an opening on one end with a channel into which is inserted a draw cord for closing said bag.

5. A combination as recited in claim 1 wherein said one or more pockets is one large pocket, and said combination further comprises means for closing the opening to said large pocket.

6. A combination as recited in claim 1 wherein said towel is rectangular and having a width between 24 inches and 30 inches and a length between 48 and 60 inches;

whereby said combination is sized for use by a child.

* * * * *